US005644615A

United States Patent [19]

Van Der Borst et al.

[11] Patent Number: 5,644,615

[45] Date of Patent: Jul. 1, 1997

[54] X-RAY COLLINATOR HAVING PLATES WITH PERIODIC RECTANGULAR OPENINGS

[75] Inventors: Johannes Van Der Borst; Johannes F. M. D'Achard Van Enschut; Theodorus J. J. M. Jenneskens, all of Eindhoven; Jacob Dobben, Almelo; Christiaan J. Ter Borch, Almelo; Hendricus G. M. Van Der Wal, Almelo, all of Netherlands

[73] Assignee: U.S. Philips Corporation, New York, N.Y.

[21] Appl. No.: 576,623

[22] Filed: Dec. 21, 1995

[30] Foreign Application Priority Data

Dec. 22, 1994 [EP] European Pat. Off. ..... 94203722

[51] Int. Cl.[6] ..... G21K 1/02

[52] U.S. Cl. ..... 378/149; 378/147

[58] Field of Search ..... 378/147, 148, 378/149, 154

[56] References Cited

U.S. PATENT DOCUMENTS 4,465,540 8/1984 Albert ..... 156/252

5,436,958 7/1995 Taylor ..... 378/147

*Primary Examiner*—Don Wong

*Attorney, Agent, or Firm*—Anne E. Barschall

[57] ABSTRACT

An X-ray collimator in an X-ray analysis apparatus, consisting of plates of X-ray absorbing material, for example tungsten, which are arranged transversely of the X-ray beam. The plates are identical and provided with a pattern of rows and columns of rectangular openings 40, 42 which have a vertical period $p_1$ and a horizontal period $p_2$. The openings take up an opening fraction $t_1$ and $t_2$ of the periods $p_1$ and $p_2$, respectively. The plates are arranged in the collimator in a series in which the ratio between two successive distances ($d_i$, $d_{i+1}$) between the plates of the series is equal to the given opening fractions $t_1$ and $t_2$ of the periods $p_1$ and $p_2$, respectively. It has been found that all directions in the X-ray beam are then intercepted except for the direction to be collimated. Moreover, this configuration also enables transverse collimation. The collimator thus formed has a substantially smaller weight and also offers space to accommodate further elements for influencing the X-ray beam.

4 Claims, 3 Drawing Sheets

X-RAY COLLINATOR HAVING PLATES WITH PERIODIC RECTANGULAR OPENINGS

The invention relates to an X-ray analysis apparatus comprising an X-ray collimator which comprises a plurality of plates of a radiation absorbing material which are provided with openings and which are arranged so as to extend parallel and offset relative to one another in the propagation direction of the radiation, each plate comprising a pattern of holes with a given period $p_1$ in a direction perpendicular to one of the sides of the holes, said period having a given opening fraction $t_1$.

The invention also relates to a collimator for use in such an X-ray analysis apparatus.

A collimator of the described kind is known from U.S. patent specification Ser. No. 4,465,540. The collimator described therein, notably with reference to FIG. 5, consists of a number of collimator plates which are arranged consecutively in parallel (in the direction of the X-rays to be collimated).

The plates shown in the cited document comprise a pattern of square holes arranged in mutually parallel rows. The rows are situated at equal distances from one another, so that they occur with a period $p_1$, being the distance between, for example the upper sides of the holes in two successive rows. This period thus consists of two parts, i.e. a part which is formed by the hole and which amounts to the fraction $t_1$ (the opening fraction), so that the dimension of the hole in this direction equals $t_1p_1$, and a pan which is formed by the intermediate absorbing material and which amounts to the fraction $(1-t_1)$, so that the dimension of the intermediate absorbing material in this direction equals $(1-t_1)p_1$.

The plates in this known collimator are arranged at equal distances from one another. The distance between these plates is determined by thin plate-shaped spacers which are clamped between the collimator plates and which are made of a material which transmits the relevant X-rays.

Collimators of this kind are comparatively heavy because a substantial fraction of their volume is filled with plates of an absorbing material. Moreover, this material, for example lead, tin or molybdenum, is heavy. The intermediate spacers also absorb a given amount of X-rays which is undesirable for some applications, notably in analysis equipment.

It is an object of the invention to provide a collimator of the kind set forth which has a lower weight and a negligibly low absorption of X-rays in the desired transmission direction.

To this end, the collimator in accordance with the invention is characterized in that the holes have a rectangular shape and that the collimator is provided with a first series of plates in which the ratio of two successive distances ($d_i$, $d_{i+1}$) between the plates of the series is equal to the given opening fraction $t_1$ of the period $p_1$.

It can be geometrically demonstrated that said arrangement of collimator plates suffices for all X-rays which do not extend in the desired transmission direction to be intercepted by at least one plate. Moreover, this results in a collimator whose weight is much lower weight and in which a large clearance exists between the collimator plates, which clearance can be used to accommodate a variety of elements for influencing or manipulating the X-ray beam.

In an attractive embodiment of the invention, the X-ray analysis apparatus is characterized in that the holes furthermore have a given second period $p_2$ in a second direction in the plane of the plates, perpendicular to the first direction, said second period having a given second opening fraction $t_2$, the collimator being provided with a second series of plates in which the ratio of two successive distances between the plates of the second series equals the given second opening fraction $t_2$ of the second period $p_2$.

These steps result in a collimator whereby collimation can be performed in two mutually perpendicular directions, the degree of collimation in one direction being independent of that in the other direction. This is achieved in that the length/width ratio of the rectangular holes is decisive in this respect.

These and other aspects of the invention will be apparent from and elucidated with reference to the embodiments described hereinafter.

Figure 1:
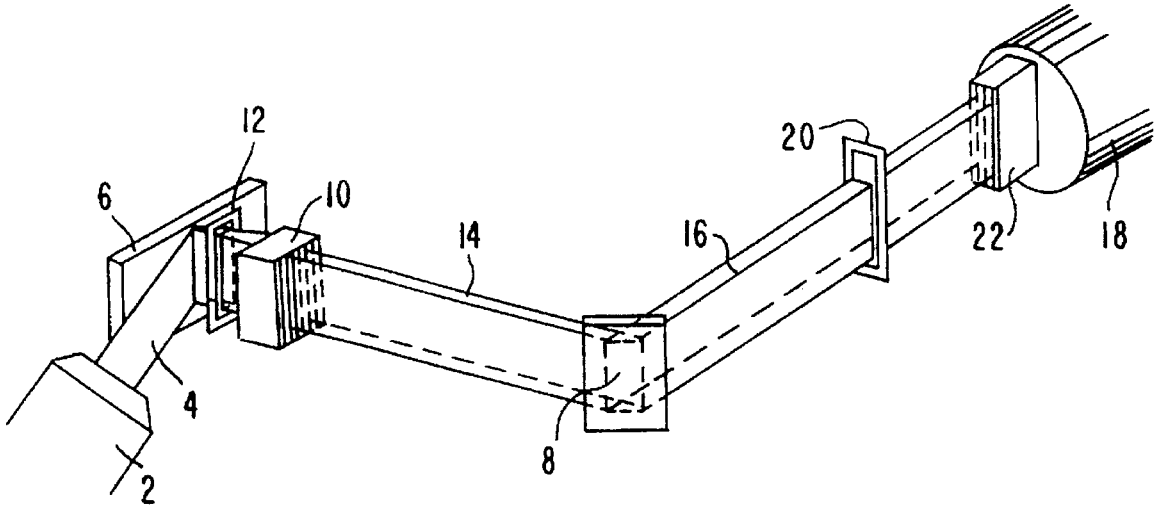
FIG. 1 shows an X-ray analysis apparatus in which the collimator in accordance with the invention can be used.

FIG. 1 shows a relevant part of an X-ray analysis apparatus in which the collimator in accordance with the invention can be used. An X-ray source 2 produces an X-ray beam 4 which is incident on a specimen 6 to be examined. In the specimen 6 the X-ray beam 4 excites X-rays which are analysed according to wavelength by an analyser crystal 8. As this analyser crystal operates according to the well-known Bragg law $2d.\sin\delta=n\lambda$ (d=distance between the reflecting lattice planes in the analyser crystal, $\delta$=the angle between the incident X-ray beam and the lattice planes, n=the order of the reflection, and $\lambda$=the X-ray wavelength), the X-rays incident on the analyser crystal must be parallel, i.e. have only one value of $\delta$. To this end, the specimen to be examined is succeeded by a first collimator 10 which selects only the radiation extending in parallel within the (narrow) divergence range of the collimator from the X-ray beam emanating from the specimen 6. The collimator 10 is preceded by a first beam limiter 12 for a first coarse directional selection of the X-rays emanating from the specimen. Depending on the angular position $\delta$ of the analyser crystal 8 relative to the X-ray beam incident on the crystal, a given wavelength $\lambda$ in conformity with said Bragg law is selected. This beam is reflected, in the form of a reflected beam 16, in the direction of the X-ray detector, via a second beam limiter 20 and a second collimator 22. The second beam limiter 20 intercepts X-rays scattered upstream of the beam limiter in a variety of locations within the analysis apparatus. The second collimator 22 parallelizes the analysed beam again in order to remove non-desirable directions from the X-rays emanating from the analyser crystal. Finally, the detector 18 measures the intensity of the wavelength thus selected so that after all desired wavelengths have been covered by rotation of the analyser crystal, the intensity has been determined in dependence on the wavelength.

Figure 2A:
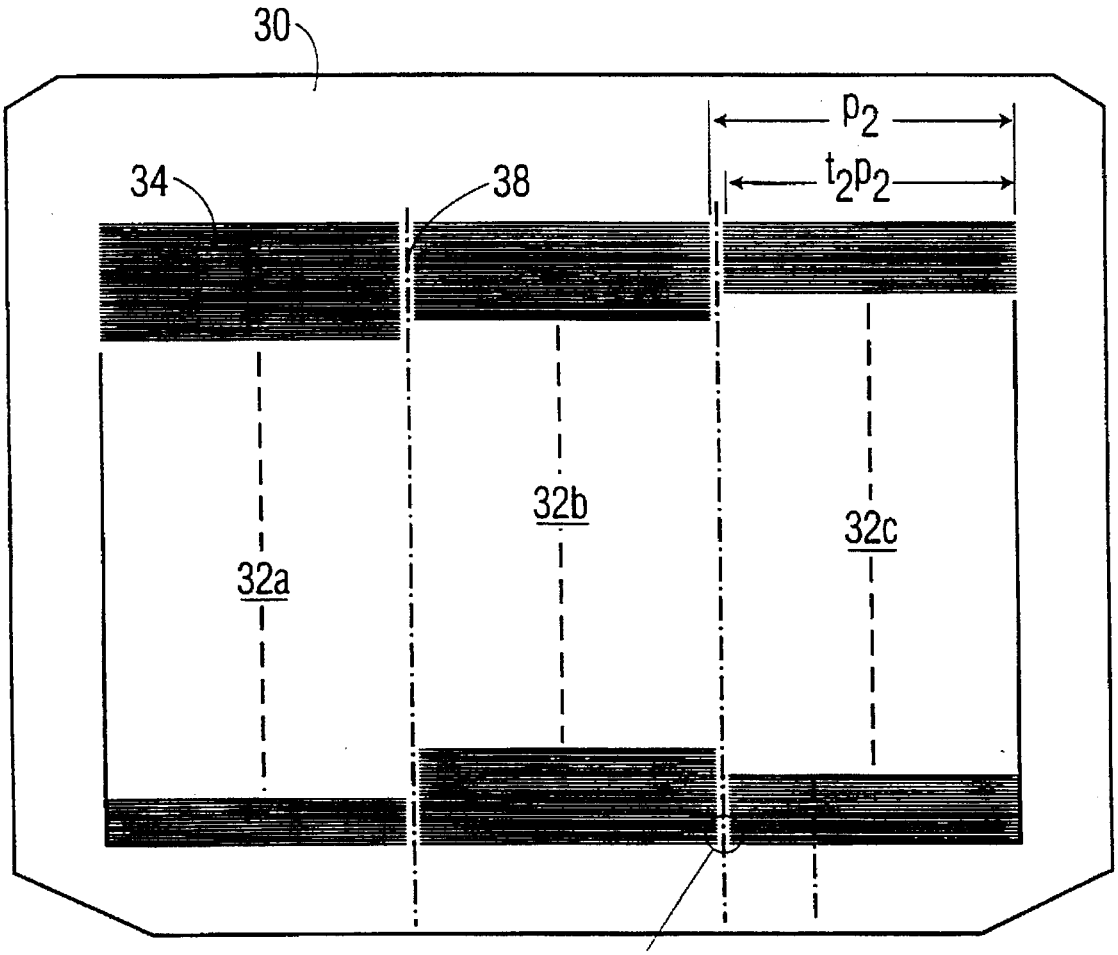
FIG. 2 shows a collimator plate for use in a collimator in accordance with the invention.
Figure 2B:
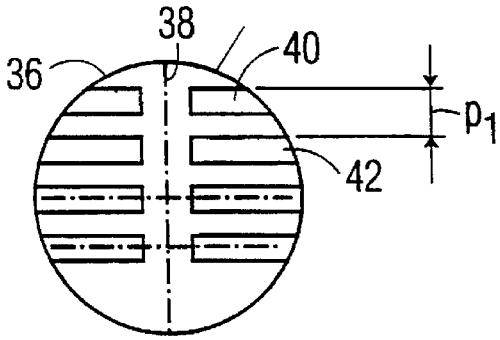

FIG. 2 shows a collimator plate for use in a collimator in accordance with the invention. The collimator plate 30 (having a height of, for example 29 mm and a width of, for example 36 mm) is made of tungsten and has a thickness of, for example 0.1 mm. The plate is subdivided into three areas 32*a*, 32*b* and 32*c* with rectangular holes 34, each of which has a width of 9.8 mm and a height of 0.1 mm. These holes can be formed by way of a customary precision manufacturing method, for example by photochemical etching as is customary in the manufacture of integrated circuits. Even though in reality all three areas are fully subdivided into holes, for the sake clarity the Figure does not show the three areas completely filled with holes. As appears more clearly from the part 36 which is shown at an enlarged scale, between the rows of holes 32*a*, 32*b* and 32*c* there is situated a non-interrupted part 38 which has a width of 0.2 mm and serves to strengthen the collimator plate 30. The holes are provided in rows of three adjacent columns, each of which is subdivided into a large number of rows which are situated one over the other. Within a column a vertical period $p_1$ of 0.2 mm exists, which period equals the distance between two corresponding points of two rows situated one above the other in a column, for example the distance between the upper sides of the rectangular hole 40 and the rectangular hole 42. The period $p_1$ has a fraction $t_1$ (of, for example 50%) which is taken up by the opening, for example 40 or 42, so that the vertical dimension of this opening equals $t_1p_1$, being 0.1 mm in this numerical example. Similarly, the collimator plate 30 has a period $p_2$ of 10 mm with an opening fraction $t_2$ of 98% in the horizontal direction, so that the absolute value of the opening in this direction equals $t_2p_2$, being 9.8 mm in this numerical example.

Figure 3:
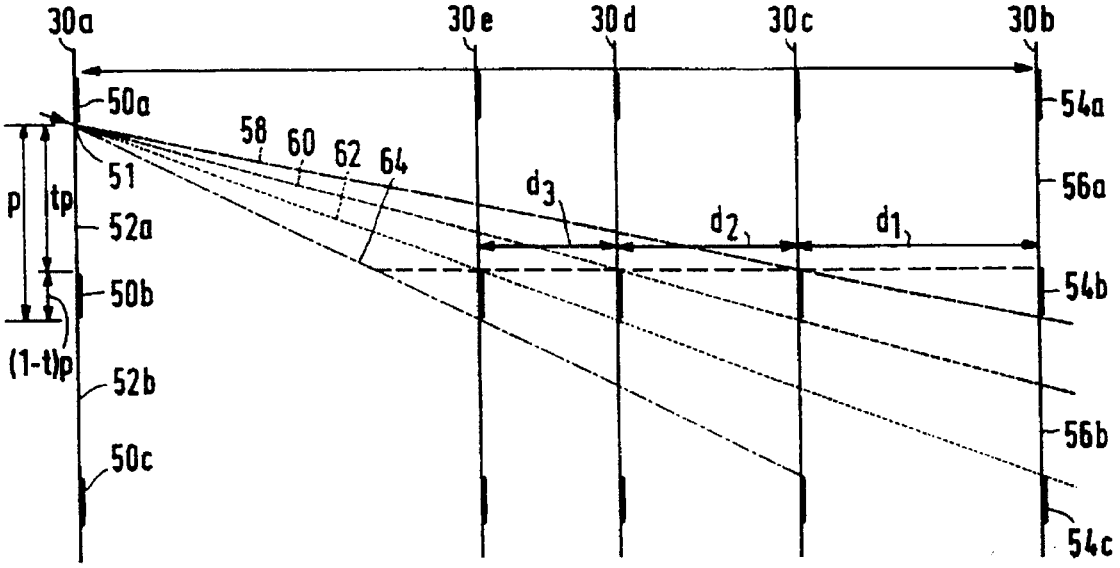
FIG. 3 shows a geometrical diagram illustrating the operation of the collimator in accordance with the invention.

FIG. 3 shows a geometrical diagram illustrating the operation of the collimator in accordance with the invention. The Figure is a diagrammatic cross-sectional view of two collimator plates 30*a* and 30*b* as shown in FIG. 2. Each of the plates 30*a* and 30*b* is subdivided into openings 52*a*, 52*b* etc. and 56*a*, 56*b* etc. which correspond to the openings 40 or 42 in FIG. 2. Between the openings 52 and 56 there are provided areas 50*a*, 50*b*, 50*c* and 54*a*, 54*b*, 54*c*, respectively, having X-ray absorbing properties. The distance between the openings is determined by the period p which may represent the vertical period $p_1$ as well as the horizontal period $p_2$. The period p is subdivided into transmissive areas 52 and 56 amounting to a fraction t, so that the open part is dimensioned t.p, and non-transmissive areas 50 and 54 amounting to a fraction 1–t, so that the non-transmissive part is dimensioned (1–t).p.

The collimator is bounded by two outer, identical plates 30*a* and 30*b* wherebetween further identical collimator plates are arranged. The outer plates are arranged at a distance $d_c$ from one another, $d_c$ being determined from the maximum desirable angular divergence (defined as half the angle between two extreme rays) of the transmitted X-ray beam, amounting to $t.p/d_c$.

It is assumed that the X-ray beam to be collimated originates from an X-ray source which is not shown in FIG. 3 and which has a large emissive surface area, so that X-rays extending in all directions are present in the X-ray beam incident on the collimator plate 30*a*. This means that at the top 51 of the opening 52*a* X-rays extend in all directions, notably in the directions 58, 60, 62 and 64 indicated. X-rays emanating from the point 51 may be transmitted by the corresponding opening 56*a* in the plate 30*b*, but not by the other openings 56*b* etc. in this plate. A boundary line of the beam aimed at the inhibited opening 56*b* is formed by the line 58. The beam emanating from the point 51 is tangent to the lower side of the absorbing part 54*b* by way of the line 58; a part of the beam emanating from the point 51 is intercepted by arranging a plate 30*c* between the plate 30*a* and the plate 30*b*, i.e. the part which is tangent to said lower side. This situation occurs if the distance $d_1$ between the plate 30*b* and the intermediate plate 30*c* is:

$$d_1:d_c=(1-t).p:p \tag{1}$$

wherefrom it follows that:

$$d_1=d_c(1-t) \tag{2}$$

Below the part of the X-ray beam thus intercepted there is situated a further part which can be intercepted by arranging a further intermediate plate 30*d* at a distance $d_2$ from the plate 30*c*, in which case it analogously holds that (using $d_1=d_c(1-t)$):

$$d_2:\{d_c-d_c(1-t)\}=\{(1-t)p\}:p \tag{3}$$

wherefrom it follows that:

$$d_2=d_c.t.(1-t) \tag{4}$$

Similarly, for the distance $d_3$ between a possibly further plate 30*e* and 30*d* it can be deduced that:

$$d_3=d_c.t^2.(1-t) \tag{5}$$

When this procedure is continued, the general expression for the distance $d_n$ is:

$$d_n=d_c.t^{n-1}.(1-t) \tag{6}$$

Comparison of the formules (2), (4) and (5) teaches that the ratio of two successive distances between the plates equals the opening fraction t of the period p.

A comparable derivation can be performed for a period and an opening fraction extending perpendicularly to the above period and opening fraction, so that transverse collimation can thus be achieved by choosing a different (or the same) value for t (i.e. $t_2$) in a direction transversely of the direction of the first value of t (i.e. $t_1$).

Figure 4:
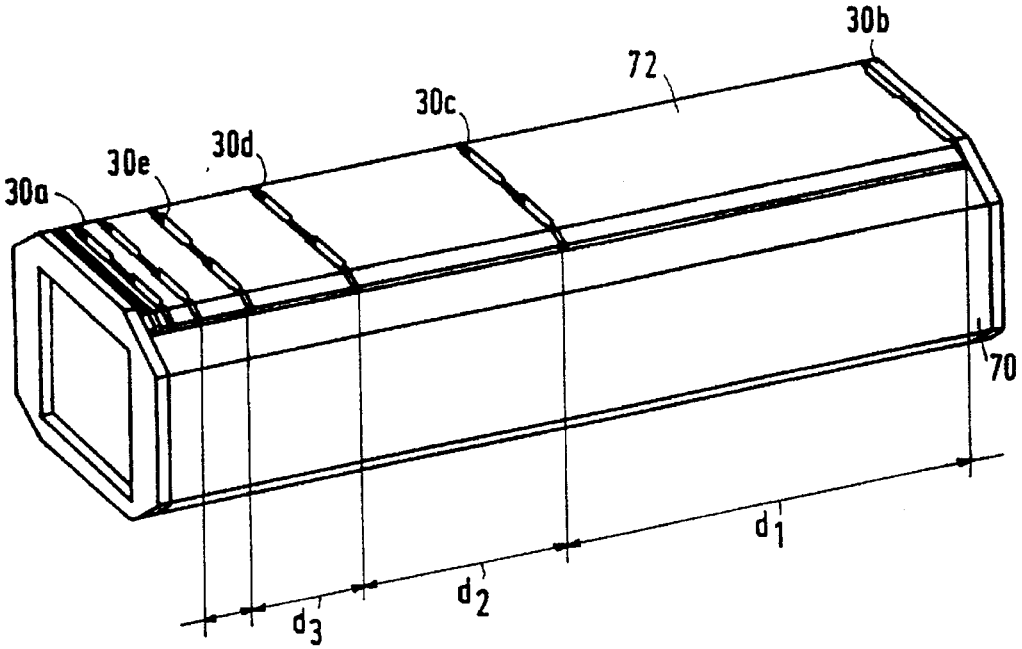
FIG. 4 shows a housing for the collimator plates in accordance with the invention.

FIG. 4 shows a housing for the collimator plates in accordance with the invention. The housing consists of a bottom section 70 and a lid section 72. In the bottom section there are provided slots (not shown) in which the collimator plates 30 can be arranged. The position of the collimator plates is thus defined. In the lid section there are also provided slots in which the collimator plates can be arranged. The Figure clearly shows the spacings $d_1$, $d_2$, $d_3$ etc. It is equally visible that the distance between the plates 30*b* and 30*c* is comparatively large, so that further elements for influencing the X-ray beam to be collimated can be accommodated in the collimator housing.

We claim:

1. An X-ray analysis apparatus comprising an X-ray collimator, which collimator comprises a plurality of plates (30*a*, 30*b* etc.) of a radiation absorbing material which are provided with openings, which plates are arranged so as to extend parallel and offset relative to one another in the propagation direction of the radiation, each plate comprising a pattern of holes (40, 42) with a given period $p_1$ in a direction perpendicular to one of the sides of the holes, said period having a given opening fraction $t_1$, characterized in that the holes (40, 42) have a rectangular shape, and the collimator is provided with a first series of plates in which the ratio of two successive distances ($d_i$, $d_{i+1}$)

between the plates of the series is equal to the given opening fraction $t_1$ of the period $p_1$.

2. An X-ray analysis apparatus as claimed in claim 1, characterized in that the holes furthermore have a given second period $p_2$ in a second direction in the plane of the plates, perpendicular to the first direction, said second period having a given second opening fraction $t_2$, the collimator being provided with a second series of plates in which the ratio of two successive distances between the plates of the second series equals the given second opening fraction $t_2$ of the second period $p_2$.

3. An X-ray collimator, comprising a plurality of plates (30*a*, 30*b* etc.) of a radiation absorbing material which are provided with openings, which plates are arranged so as to extend parallel and offset relative to one another in the propagation direction of the radiation, each plate comprising a pattern of holes (40, 42) with a given period $p_1$ in a direction perpendicular to one of the sides of the holes, said period having a given opening fraction $t_1$, characterized in that the holes (40, 42) have a rectangular shape, and the collimator is provided with a first series of plates in which the ratio of two successive distances ($d_i$, $d_{i+1}$) between the plates of the series is equal to the given opening fraction $t_1$ of the period $p_1$.

4. A collimator as claimed in claim 3, characterized in that the holes furthermore have a given second period $p_2$ in a second direction in the plane of the plates, perpendicular to the first direction, said second period having a given second opening fraction $t_2$, the collimator being provided with a second series of plates in which the ratio of two successive distances between the plates of the second series equals the given second opening fraction $t_2$ of the second period $p_2$.

* * * * *